US008973549B2

(12) United States Patent
Mahfoudh et al.

(10) Patent No.: US 8,973,549 B2
(45) Date of Patent: Mar. 10, 2015

(54) RADIATOR FRAME FOR A COOLING MODULE, AND COOLING MODULE OR COOLING DEVICE FOR AN INTERNAL COMBUSTION ENGINE

(71) Applicant: Robert Bosch GmbH, Stuttgart (DE)

(72) Inventors: Samir Mahfoudh, Buehl (DE); Joern Merwitz, Weingarten (DE)

(73) Assignee: Robert Bosch GmbH, Stuttgart (DE)

( * ) Notice: Subject to any disclaimer, the term of this patent is extended or adjusted under 35 U.S.C. 154(b) by 98 days.

(21) Appl. No.: 13/731,212

(22) Filed: Dec. 31, 2012

(65) Prior Publication Data

US 2013/0168043 A1 Jul. 4, 2013

(30) Foreign Application Priority Data

Dec. 29, 2011 (DE) ..... 10 2011 090 068

(51) Int. Cl.

| | |
|---|---|
| ***F02B 75/12*** | (2006.01) |
| ***F28F 9/007*** | (2006.01) |
| ***F28F 9/00*** | (2006.01) |
| *F02F 7/00* | (2006.01) |
| *F02B 75/02* | (2006.01) |

(52) U.S. Cl.

CPC ..... *F28F 9/007* (2013.01); *F28F 9/002* (2013.01); *F02F 7/0007* (2013.01); *F02F 7/0053* (2013.01); *F02F 7/0012* (2013.01); *F05C 2201/021* (2013.01); *F02B 2075/025* (2013.01)

USPC ..... 123/195 R

(58) Field of Classification Search

CPC ..... F02F 7/0053; F02F 7/0007; F02F 7/0012; F02B 2075/025; F05C 2201/021

USPC ..... 123/195 R

See application file for complete search history.

(56) References Cited

U.S. PATENT DOCUMENTS

2002/0157812 A1* 10/2002 Anderson et al. ..... 165/67

* cited by examiner

*Primary Examiner* — Lindsay Low
*Assistant Examiner* — Charles Brauch
(74) *Attorney, Agent, or Firm* — Michael Best & Friedrich LLP

(57) ABSTRACT

A radiator frame (10) for a cooling module of an internal combustion engine, having a fastening element (100) for fastening the cooling module to/on/in a radiator of the internal combustion engine, the fastening element (100) having a retaining face (123), by which the cooling module (1) can be locked in a translational and optionally a rotational direction, and an individual fastening element (100) has at least two retaining faces (123) in such a way that said fastening element (100) can be seated on mating faces at/on/in the radiator.

20 Claims, 3 Drawing Sheets

RADIATOR FRAME FOR A COOLING MODULE, AND COOLING MODULE OR COOLING DEVICE FOR AN INTERNAL COMBUSTION ENGINE

BACKGROUND OF THE INVENTION

The invention relates to a radiator frame for a cooling module of an internal combustion engine, having a fastening element for fastening the cooling module to/on/in a radiator of the internal combustion engine. Furthermore, the invention relates to a cooling module or a cooling device for an internal combustion engine of a motor vehicle, having a radiator frame according to the invention.

A motor vehicle which can be driven by an internal combustion engine has as a rule a water cooling system which guides a cooling water which is heated by the internal combustion engine through a radiator, the cooling water discharging its heat to a cooling air which flows through the radiator. At a standstill and/or at slow speeds of the motor vehicle, a heat build-up occurs in the radiator which is typically arranged in the frontal region of the motor vehicle. In order to avoid a heat build-up of this type, the radiator is as a rule assigned a cooling module which has a fan and serves to additionally convey the cooling air through the radiator. The fan which has a fan motor and a fan wheel is as a rule accommodated on/in a radiator frame behind the radiator in the direction of the vehicle interior of the motor vehicle, which radiator frame is in turn positioned and fastened with regard to the radiator.

The cooling module of the radiator as a rule has a single fan wheel or a plurality of fan wheels, a number, preferably corresponding to the former, of electric motors (fan motors), and the radiator frame. Furthermore, the radiator frame serves to guide the cooling air in as optimum a manner as possible for cooling the radiator and therefore the internal combustion engine and to secure a unit comprising the electric motor or motors and the fan wheel or wheels. A mechanical attachment of the radiator frame and therefore of the cooling module to the radiator or in the vicinity of the radiator of the motor vehicle usually takes place, depending on vehicle type, by means of from at least four to over six fastening elements. That is to say, in a mounted position of the cooling module, from at least four to over six bearing regions are usually formed between the cooling module and the radiator or the motor vehicle.—The fan wheel has a hub which is preferably produced from plastic, a driver which is preferably sintered, and fan blades which are connected, preferably integrally, to the hub on a radial inner side and, likewise preferably integrally, to a fan belt of the fan wheel on a radial outer side. The fan belt of the fan wheel mainly works as a fluid-mechanical seal with respect to the radiator frame.

The fastening elements of the radiator frame serve to suppress the degrees of freedom (translation and rotation in in each case three spatial directions) between the radiator and the radiator frame and therefore the cooling module, or of an attachment of the radiator frame or the cooling module to the motor vehicle. During operation of the motor vehicle, not inconsiderable forces act on the cooling module and therefore on the radiator frame. That is to say, depending on a shaking or vibratory load, different forces and/or moments which change over time act on the fastening elements of the radiator frame. Loads in a y-direction, that is to say a transverse direction of the motor vehicle, and therefore on a fastening element of the radiator frame which locks the cooling module in these directions at least in a single y-direction are to be considered critically, in particular; that is to say, in particular, therefore a fastening element of a locating or fixed bearing between the radiator frame and its mechanical attachment in the motor vehicle. A fracture of the fastening element can occur here.

SUMMARY OF THE INVENTION

It is an object of the invention to specify an improved radiator frame for a cooling module of an internal combustion engine and an improved cooling module or an improved cooling device for an internal combustion engine of a motor vehicle. Here, the radiator frame is to be improved mechanically, that is to say a premature mechanical failure of the radiator frame is to be prevented effectively; a mechanical durability of a fastening element of the radiator frame is to be improved. Here, a previous design of a radiator frame for a cooling module and/or its mechanical attachment in the motor vehicle are/is to be interfered with structurally as little as possible. Furthermore, the radiator frame according to the invention is to be improved in such a way that it can be mounted in an established interface on a radiator of the motor vehicle or in the motor vehicle. Furthermore, the radiator frame according to the invention is to be capable of being produced simply and inexpensively.

The object of the invention is achieved by means of a radiator frame for a cooling module of an internal combustion engine, having a fastening element for fastening the cooling module to/on/in a radiator of the internal combustion engine; and a cooling module or a cooling device for an internal combustion engine of a motor vehicle.

The radiator frame according to the invention having the fastening element according to the invention or a fastening element according to the invention for a radiator frame has a retaining face, by means of which the radiator frame or a cooling module which has the radiator frame can be locked in a translational and optionally a rotational direction, the individual fastening element having at least two retaining faces in such a way that said fastening element can be seated on preferably two mating faces at/on/in the radiator or on preferably two mating faces in the motor vehicle. The cooling module according to the invention and the cooling device according to the invention have a radiator frame according to the invention or a fastening element according to the invention.

The radiator frame according to the invention is considerably improved mechanically as a result of a homogenization according to the invention of a force on/into the fastening element according to the invention. Here, a bending moment (see below) which occurs in the prior art on the fastening element is reduced considerably or no longer exists, as a result of which the mechanical loading of the fastening element is reduced considerably. This is reduced again considerably by the second retaining face on/in the fastening element. That is to say, according to the invention, a premature mechanical failure of the radiator frame is prevented effectively; the fastening element is improved in such a way that a previous design of the radiator frame and/or its mechanical attachment in the motor vehicle has to be interfered with structurally by the invention as little as possible; the fastening element can be used in an established interface with the radiator or the motor vehicle and, moreover, the radiator frame according to the invention can be produced simply and inexpensively.

In embodiments of the invention, the at least two retaining faces of the fastening element are provided in such a way that a movement of the radiator frame in a transverse direction of the radiator frame or of the motor vehicle can be prevented by means of the retaining faces. Here, a respective surface vector of the at least two retaining faces can point mainly or substantially in a direction of an acceleration, in particular a transverse acceleration, of the radiator frame or of the motor vehicle. Here, two retaining faces of the individual fastening element can be configured so as to be separate from one another spatially or contiguous on the fastening element. Here, an individual retaining face can be configured mainly or substantially as a rectangle or in the manner of an ellipse segment, it being possible for the individual retaining face to be curved.

In embodiments of the invention, the longitudinal extents of two retaining faces of an individual fastening element extend in parallel and/or at an angle, in particular at a right angle, with respect to one another. Furthermore, the transverse extents of two retaining faces of an individual fastening element can be arranged in parallel, in particular on a straight line, or at an angle, in particular at a right angle, with respect to one another. Furthermore, two retaining faces of an individual fastening element can be arranged parallel to one another, in particular lying in one plane, or offset with respect to one another with regard to one plane.

The fastening element according to the invention can have at least two latching devices which are separate from one another or at least two latching devices which are connected to one another, which latching devices enclose or run around a shank of the fastening element at least partially in its circumferential direction. Furthermore, the shank of the fastening element according to the invention can have a head at its free end, which head has the at least two retaining faces at least on two sides so as to point away from the shank. Here, the at least two retaining faces of the head can be provided so as to lie opposite one another and/or so as to be adjacent to one another and preferably so as to face the radiator frame or the shank. Contiguous retaining faces form, in particular, an L-shape or a U-shape. If the retaining faces run completely around the shank, this can result, for example, in an outwardly square, rectangular, elliptical or circular shape.

In preferred embodiments of the invention, the at least two retaining faces of the fastening element are spaced apart from one another at least over a diameter of the shank. Furthermore, at least one retaining face of the fastening element can be provided so as to be adjacent, preferably directly adjacent, to the shaft and so as to lie laterally away from the latter, which preferably takes place at a right angle. According to the invention, the at least two holding faces or an entire retaining face of the fastening element can run around the shank at least partially and optionally in an interrupted manner, it being possible for a coverage in the circumferential direction of the shank to be from approximately 90° to approximately 360°.

In preferred embodiments of the invention, the fastening element is configured in one piece with the radiator frame, in particular in one piece in material terms and preferably integrally. Furthermore, the fastening element itself, in particular the fastening element for an individual bearing region of the radiator frame, can be configured in one piece, in particular in one piece in material terms and preferably integrally. In a case of this type, the fastening element is, for example, not slotted, which would make two resilient brackets out of the fastening element. Here, the shank of the fastening element, in particular of the individual fastening element for an individual bearing region of the radiator frame, is configured mainly or substantially as a solid profile.

The fastening element of the radiator frame for fastening the cooling module can be a fastening element for a locating bearing or a fixed bearing of the cooling module. Furthermore, the fastening element can be the only fastening element for locking the radiator frame in the transverse direction of the radiator frame or of the motor vehicle. For a mounted state of the radiator frame or of the cooling module, a retaining face can be capable of being seated mainly or substantially on a relevant mating face in a plane-parallel manner. Furthermore, it is preferred that the fastening element is configured as a retaining bracket, a fastening bracket or as a latching hook.

BRIEF DESCRIPTION OF THE DRAWINGS

In the following text, the invention will be explained in greater detail using exemplary embodiments with reference to the appended drawing. In the figures of the drawing.

DETAILED DESCRIPTION

Figure 1:
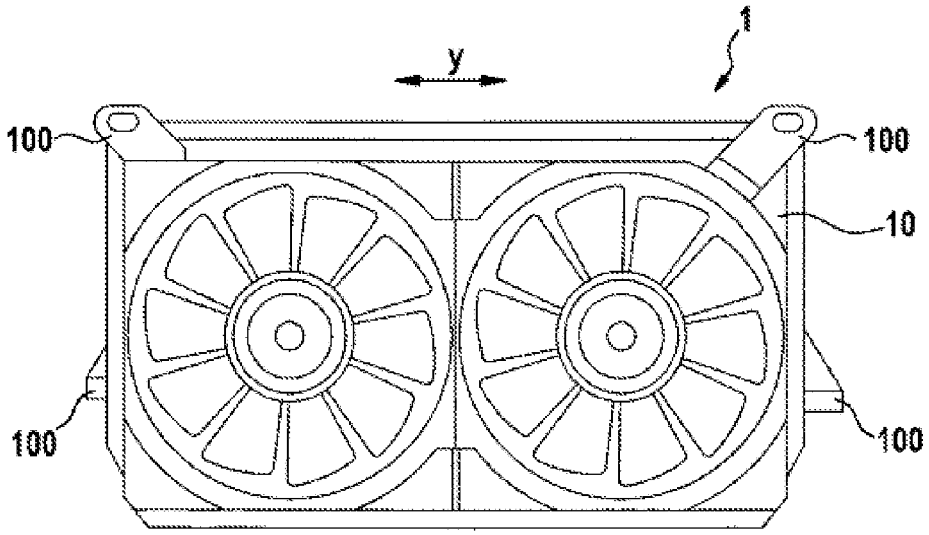
Fig. 1 (Prior Art)
FIG. 1 shows a front view of a cooling module from the prior art which has two fan wheels for a radiator of an internal combustion engine, FIG. 2 likewise shows a front view of a radiator frame from the prior art for a cooling module having a single fan wheel, FIG. 3 once again shows a front view of a fastening element of a radiator frame from the prior art.
Figure 2:
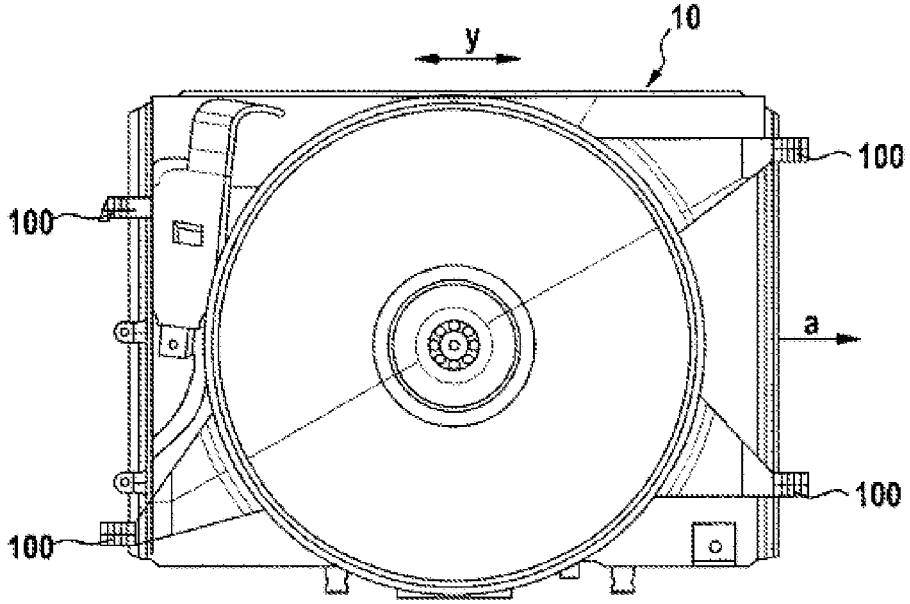
Fig. 2 (Prior Art)
Figure 3:
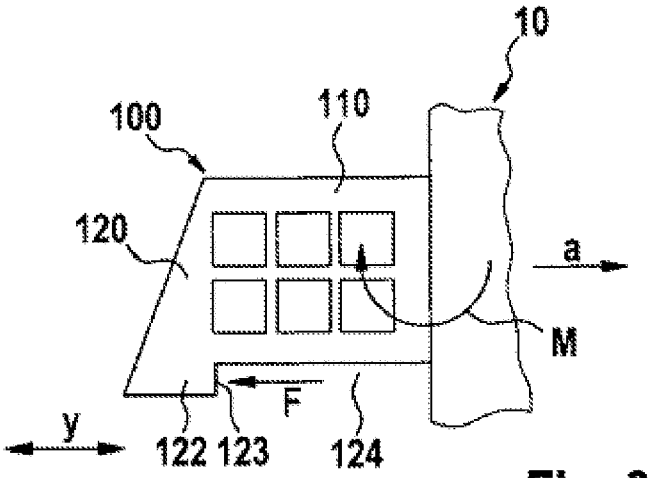
Fig. 3 (Prior Art)

In the following text, the invention will be explained in greater detail, starting from disadvantages of the prior art (FIGS. 1 to 3). However, the invention is not restricted here to the exemplary embodiments which are shown or explained, but rather can be applied to all fastening elements 100 of a radiator frame 10 or of a frame basic body 10 or of a frame plenum 10, as long as a fastening element 100 of this type has at least two retaining faces 123 which are configured so as to be either separate from one another spatially and/or contiguous, and in the process their respective longitudinal extents L or transverse extents Q do not coincide, which is the case, for example, in a retaining face 123 which is L-shaped or U-shaped overall—in the former case there are actually two retaining faces 123, 123 and in the latter case there are actually three retaining faces 123, 123, 123 (cf. FIG. 4).

During operation of the motor vehicle, acceleration forces a (see FIGS. 2 to 4) act on a cooling module 1 (see FIG. 1) for a motor vehicle or a radiator 2 (see FIG. 5, a small detail) and therefore a radiator frame 10 (see FIGS. 1 and 2) of the cooling module 1, which acceleration forces a can be up to 50 $m/s^2$ and which acceleration forces, for example in the case of a shaking load in the y-direction, are usually to be absorbed by means of a single fastening element 100. Here, the y-direction corresponds to a transverse direction y of the motor vehicle, of the radiator 2, of the cooling module 1 and of the radiator frame 10. Here, high and, in many cases, impermissible forces on the fastening element 100 are produced, which can lead to a fracture of the fastening element 100. The fracture of the fastening element 100 is to be attributed to a superimposition of a tensile and flexural load and a resulting overall stress on/in the fastening element 100.

The tensile load on the fastening element 100 results from a force F from the acceleration a of the radiator frame 10 during operation of the motor vehicle on the only retaining face 123 of the fastening element 100 (see FIG. 3). Since the force F can act only on one side of the fastening element 100, that is to say asymmetrically, a flexural load is produced in addition to the tensile load, which flexural load leads to a mechanical moment on the fastening element 100. The mechanical stresses from the tensile and flexural load are added, in particular, at an integral connection of the retaining face 123 to a shank 110 of the fastening element 100 and an integral connection between the fastening element 100 and the radiator frame 10 in a surrounding area with respect to the retaining face 123. At said points, the fastening element 100 tends to become damaged, which damage can lead as far as to the fracture of said fastening element 100.

The mechanical stress from the force F is a quotient of an active force F (see FIG. 3) and a load-bearing cross section of a retaining face 123. The greater a load-bearing cross section of the fastening element 100, the smaller the resulting mechanical stress on/in the fastening element 100. In order to reduce the mechanical stress on/in the fastening element 100, the load-bearing cross section of the fastening element 100 is increased in such a way that the bending moment M is also preferably reduced here and disappears in a favorable case. According to the invention, this takes place in relation to a fastening element 100 according to FIG. 3 in such a way that a second latching device 122 or a second retaining lug 122 or a second shoulder 122 is provided at a free end of the fastening element 100 or its shank 110 or its limb 110 (see FIG. 4).

The invention therefore relates to a design or a layout of one or a plurality of fastening elements 100 of the radiator frame 10. A fastening element 100 of this type can also be called, for example, a retaining bracket 100, fastening bracket 100 or latching hook 100. However, it does not have to be the case here that the load-bearing cross section of the fastening element 100 according to the invention is increased significantly with respect to the prior art; this can also remain identical, for example, that is to say a previous load-bearing cross section is distributed to two retaining faces 123, the bending moment M disappearing, however, during operation of the motor vehicle. This can be sufficient in the case of certain pairings of cooling modules 1 and radiators 2.

According to the invention, the force F which results from the acceleration a no longer acts on the fastening element 100 on one side, but rather, in the exemplary embodiments according to the invention which are shown (FIGS. 4 to 6), is distributed to two or more sides of the fastening element 100, as a result of which a resulting mechanical stress is avoided as a rule. Furthermore, the bending moment M disappears on account of the symmetrical load according to the invention of the fastening element 100, and this therefore brings about an additional mechanical relief of the fastening element 100. Furthermore, the interface is likewise loaded symmetrically or more symmetrically on the side of the motor vehicle and the radiator 2.

Figure 4:
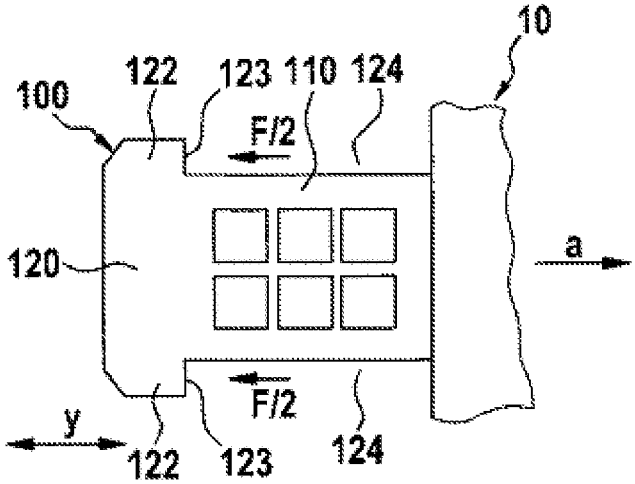
FIG. 4 shows a view, which is analogous to FIG. 3, of a first embodiment of a fastening element according to the invention of a radiator frame according to the invention.
Figure 5:
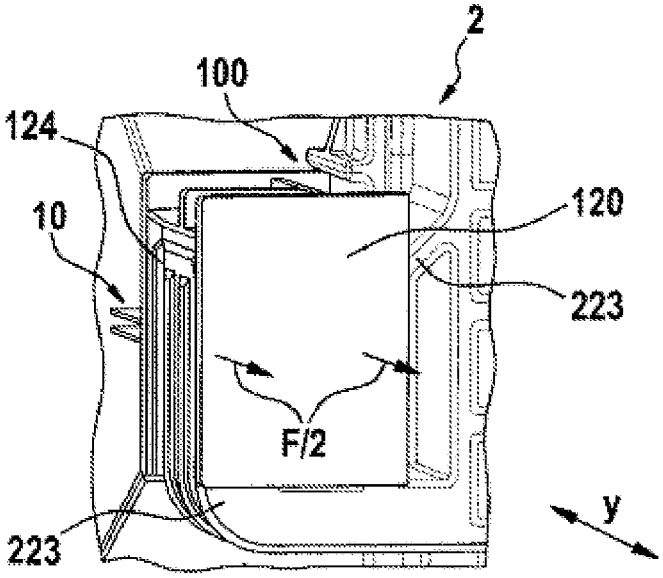
FIG. 5 shows a perspective view of a second embodiment of the fastening element according to the invention of the radiator frame according to the invention in a mounted position on a radiator of a motor vehicle, and FIG. 6 likewise shows a perspective view of a third embodiment of the fastening element according to the invention of the radiator frame according to the invention.
Figure 6:
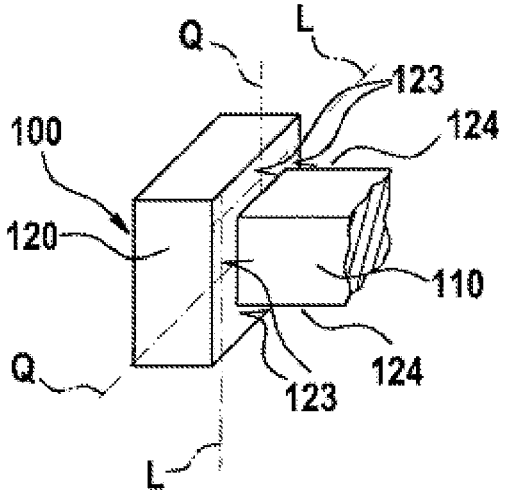

In the following text, the embodiments of the invention which are shown in FIGS. 4 to 6 will be explained in greater detail. In all the embodiments of the invention which are shown, the fastening element 100 is configured, in particular, integrally and laterally on the radiator frame 10 and preferably projects away from the latter in the y-direction. A protrusion in another direction, that is to say to the top/bottom or to the front/rear, and possibly an oblique protrusion are also of course possible. The fastening element 100 preferably extends away at a right angle from the radiator frame 10. Here, a cross section of the shank 110 of the fastening element 100 is shaped in any desired manner, a square or a rectangular cross section being preferred, but it is also of course possible for a circular or elliptic and optionally a cross section composed from these shapes to be used. Here, the diameters of the shank 110 are preferably constant over its entire length as far as a head 120 at a free end of the shank 110, the head 120 widening the shank 110. The head 120 can also be configured, for example, as a projection 120 or foot 120.

The head 120 of the fastening element 100 serves to latch the radiator frame 10 in an apparatus 2 (see FIG. 5) for fastening or hooking the cooling module 1 in the motor vehicle or a radiator 2 of the motor vehicle. For this purpose, on its inner side which lies opposite the radiator frame 10, the head 120 has at least two retaining faces 123 or locking faces 123 which are preferably arranged substantially parallel to a relevant side of the radiator frame 10. The retaining faces 123 are part of the latching devices 122 or the retaining lugs 122 or the shoulders 122 which are formed on the head 120 of the fastening element 100 and substantially constitute the latter. Between the respective retaining face 123 which is formed as a projection on the shank 110 and the actual radiator frame 10, the radiator frame 10 has a recess 124 which is firstly accessible from the outside and is secondly delimited by the retaining face 123, the shank 110 and the actual radiator frame 10.

A mechanical attachment of the apparatus 2 for fastening the cooling module 1 or a mechanical attachment of the radiator 2 can be received within the recess 124, which mechanical attachment is configured, for example, in FIG. 5 as a bracket which engages there. A hoop (not shown in the drawing) which reaches around the shank 110 and can optionally be closed can of course be used. In a mounted state of the cooling module 1 in the motor vehicle, the bracket, the hoop and/or some other projection of the apparatus 2 for fastening the cooling module 1 or the radiator 2 is then received in the at least two recesses 124 of the fastening element 100 and, optionally with a mechanical play, is clamped between a lateral boundary of the radiator frame 10 and the retaining faces 123 of the fastening element 100. Here, in each case one mating face 223 for the relevant retaining face 123 is formed on the bracket, the hoop or the other kind of projection of the apparatus 2 for hooking in the cooling module 1 or the radiator 2.

The at least two latching devices 122 or their retaining faces 123 are situated on at least two lateral regions of the shank 110 or are formed on at least two lateral regions of the fastening element 100, that is to say the head 120 projects from the shank 110 at at least two regions. Here, the at least two latching devices 122 can be connected integrally or their retaining faces 123 can merge into one another, or the at least two latching devices 122 or their retaining faces 123 can be spaced apart from one another. Here, in the case of a round cross section, an individual lateral region covers from at least approximately 45° to over approximately 90° of a complete circumference of the shank 110. In the case of a square or rectangular cross section of the shank 110, the at least two latching devices 122 or their retaining faces 123 then extend analogously along two regions which in each case can be a section of a side. A region of this type is preferably exactly as long as a side of the cross section.

The embodiment of FIG. 4 shows a fastening element 100, the head 120 of which has two retaining faces 123 which are arranged opposite one another and in each case face the radiator frame 10. In the case of a typical and/or critical transverse acceleration a in the y-direction, the result in this embodiment, in comparison with a fastening element 100 from the prior art (see FIG. 3), is a halved force on an individual retaining face 123 (see F/2 in FIG. 4). Here, a mechanical stress from the tensile force F is likewise halved. Furthermore, no moment M occurs on the fastening element 100, since the two forces F/2 in FIG. 4 are introduced symmetrically into the fastening element 100 or its shank 110 and therefore also the radiator frame 10. As a result, a mechanical stress from the moment M likewise disappears.

The second embodiment (shown in FIG. 5) of the fastening element 100 shows a fixed bearing or a locating bearing of the radiator frame 10 on the apparatus 2 for fastening or hooking in the cooling module 1 or the radiator 2. In the mounted position of the radiator frame 10, an inner side, facing the radiator frame 10, of the head 120 of the fastening element 100, which inner side has the two retaining faces 123, is seated on two outer mating faces 223 of the apparatus 2 for fastening the cooling module 1 or the radiator 2. Here, the head 120 is of plate-shaped configuration, the shank 110 (which cannot be seen in FIG. 5) of the fastening element 100 engaging into an inner space, accessible from outside and situated between the mating faces 223, on/in the apparatus 2 for fastening the cooling module 1 or the radiator 2.

In order to further increase a rigidity or a load-bearing capability of the fastening element 100, as great an overlap as possible can be aimed for between the fastening element 100 and an interface on the apparatus 2 for fastening or hooking in the cooling module 1 or the radiator 2. That is to say, the retaining faces 123 which can be used for this purpose are to cover more than 180° here or are to be provided on the shank 110 on more than two sides. For instance, the embodiment of FIG. 6 shows a fastening element 100, by means of which an all-round overlap is possible between the fastening element 100 of the radiator frame 10 and the interface. That is to say, in the case of the square or rectangular cross section of the shank 110, the four retaining faces 123 which are connected among one another are situated on all four sides so as to point away from the shank 110.

As a result, the force F which results from the acceleration a is distributed to the circumferential retaining faces 123, which results in a homogeneous loading of the fastening element 100. That is to say, the entire fastening element 100 is load-bearing, and not only a part thereof. The interface which is configured so as to correspond to the fastening element 100 and to its circumferential retaining faces 123 is likewise mechanically loaded more homogeneously. The resulting stresses and strains on/in the fastening element 100 and on/in the interface are likewise smaller and therefore less critical.

The invention claimed is:

1. A radiator frame for a cooling module (1) of an internal combustion engine, having a fastening element (100) for fastening the cooling module (1) to a radiator (2) of the internal combustion engine, the fastening element (100) having at least two retaining faces (123), by means of which the cooling module (1) can be locked in a translational and optionally a rotational direction, characterized in that the fastening element (100) includes a shank (110) extending in a shank extension direction from an edge of the radiator frame, the shank extension direction being parallel to a transverse direction (y) that is substantially perpendicular to a flow through direction of the cooling module (1) and the radiator (2), the at least two retaining faces (123) being arranged symmetrically about the shank extension direction such that the at least two retaining faces (123) of the fastening element (100) can be seated on mating faces(223) of the radiator (2) to reduce or eliminate a bending moment during contact between the at least two retaining faces (123) and the mating faces (223) upon an acceleration (a) in the transverse direction (y).

2. The radiator frame according to claim 1, characterized in that the at least two retaining faces (123) are provided in such a way that a movement of the radiator frame (10) in the transverse direction (y) can be prevented by means of said retaining faces (123).

3. The radiator frame according to claim 1, characterized in that two retaining faces (123) of the individual fastening element (100) are configured so as to be separate from one another spatially or contiguous on the fastening element (100).

4. The radiator frame according to claim 1, characterized in that the longitudinal extents (L) of two retaining faces (123) of an individual fastening element (100) are arranged in parallel or at an angle.

5. The radiator frame according to claim 1, characterized in that the fastening element (100) has at least two latching devices which are separate from one another or at least two latching devices which are connected to one another, which latching devices enclose a shank 110) of the fastening element (100) at least partially in its circumferential direction.

6. The radiator frame according to claim 1, characterized in that the shank (110) has a head (120) at its free end, which head (120) has the at least two retaining faces (123) at least on two sides so as to point away from the shank (110), the at least two retaining faces (123) of the head (120) being provided so as to lie opposite one another and/or so as to be adjacent to one another.

7. The radiator frame according to claim 1, characterized in that the at least two retaining faces (123) of the fastening element (100) are spaced apart from one another at least over a diameter of the shank (110).

8. The radiator frame according to claim 1, characterized in that the at least two retaining faces (123) or an entire retaining face (123, 123, . . . ) of the fastening element (100) runs around the shank (110) at least partially and optionally in an interrupted manner, a coverage in the circumferential direction of the shank (110) being at least approximately 135°.

9. The radiator frame according to claim 1, characterized in that the fastening element (100) for fastening the cooling module (1) is a fastening element (100) for a locating bearing or a fixed bearing of the cooling module (1);

the fastening element (100) is the only fastening element (100) for locking the radiator frame (10) in the transverse direction (y)

the fastening element (100) is configured in one piece with the radiator frame (10);

the fastening element (100) is configured in one piece;

the shank (110) of the fastening element (100) is configured mainly or substantially as a solid profile;

for a mounted state of the radiator frame (10) or of the cooling module (1), a retaining face (123) can be seated mainly or substantially on a relevant mating face (223) in a plane-parallel manner; and/or the fastening element (100) is configured as a retaining bracket (100), a fastening bracket (100) or a latching hook (100).

10. A cooling module or cooling device for an internal combustion engine of a motor vehicle, characterized in that the cooling module (1) or the cooling device has a radiator frame (10) according to claim 1.

11. The radiator frame according to claim 1, characterized in that each of the at least two retaining faces (123) lies perpendicular to the transverse direction(y).

12. The radiator frame according to claim 1, characterized in that two retaining faces (123) of the individual fastening element (100) are configured so as to be separate from one another spatially or contiguous on the fastening element (100), an individual retaining face (123) being configured mainly or substantially as a rectangle or in the manner of an ellipse segment, it being possible for the individual retaining face (123) to be of curved configuration.

13. The radiator frame according to claim 1, characterized in that the transverse extents (Q) of two retaining faces (123) of an individual fastening element (100) are arranged in parallel.

14. The radiator frame according to claim 1, characterized in that two retaining faces (123) of an individual fastening element (100) are arranged parallel to one another.

15. The radiator frame according to claim 1, characterized in that the longitudinal extents (L) of two retaining faces (123) of an individual fastening element (100) are arranged in parallel or at a right angle, with respect to one another;

the transverse extents (Q) of two retaining faces (123) of an individual fastening element (100) are arranged on a straight line, or at a right angle, with respect to one another, and two retaining faces (123) of an individual fastening element (100) are arranged lying in one plane, or offset with respect to one another with regard to one plane.

16. The radiator frame according to claim 1, characterized in that the shank (110) has a head (120) at its free end, which head (120) has the at least two retaining faces (123) at least on two sides so as to point away from the shank (110), the at least two retaining faces (123) of the head (120) being provided so as to lie opposite one another and/or so as to be adjacent to one another and so as to face the shank (110).

17. The radiator frame according to claim 1, characterized in that at least one retaining face (123) of the fastening element (100) is provided so as to be adjacent to the shank (110) and so as to lie laterally away from the latter.

18. The radiator frame according to claim 1, characterized in that at least one retaining face (123) of the fastening element (100) is provided so as to be directly adjacent to the shank (110) and so as to lie laterally away from the latter.

19. The radiator frame according to claim 1, characterized in that the at least two retaining faces (123) or an entire retaining face (123, 123, . . . ) of the fastening element (100) runs around the shank (110) at least partially and optionally in an interrupted manner, a coverage in the circumferential direction of the shank (110) being approximately 360°.

20. The radiator frame according to claim 1, characterized in that the fastening element (100) for fastening the cooling module (1) is a fastening element (100) for a locating bearing or a fixed bearing of the cooling module (1);

the fastening element (100) is the only fastening element (100) for locking the radiator frame (10) in the transverse direction (y);

the fastening element (100) is configured in one piece in material terms and integrally;

the fastening element (100) for an individual bearing region of the radiator frame (10) is configured in one piece in material terms and integrally;

the shank (110) of the fastening element (100) for an individual bearing region of the radiator frame (10), is configured mainly or substantially as a solid profile;

for a mounted state of the radiator frame (10) or of the cooling module (1), a retaining face (123) can be seated mainly or substantially on a relevant mating face (223) in a plane-parallel manner; and/or the fastening element (100) is configured as a retaining bracket (100), a fastening bracket (100) or a latching hook (100).

* * * * *